US011220875B2

(12) United States Patent
King et al.

(10) Patent No.: US 11,220,875 B2
(45) Date of Patent: Jan. 11, 2022

(54) RETRIEVAL OF BOTTOM HOLE ASSEMBLY COMPONENTS FROM A SUBTERRANEAN WELL

(71) Applicant: KING SOUTHWEST & CONSULTING OF CYPRESS, Houston, TX (US)

(72) Inventors: George R. King, Houston, TX (US); Santos D. Ortiz, Houston, TX (US)

(73) Assignee: KING SOUTHWEST & CONSULTING OF CYPRESS, Houston, TX (US)

( * ) Notice: Subject to any disclaimer, the term of this patent is extended or adjusted under 35 U.S.C. 154(b) by 0 days.

(21) Appl. No.: 16/719,401

(22) Filed: Dec. 18, 2019

(65) Prior Publication Data

US 2020/0240225 A1 Jul. 30, 2020

Related U.S. Application Data

(60) Provisional application No. 62/796,303, filed on Jan. 24, 2019.

(51) Int. Cl.
*E21B 23/03* (2006.01)
*E21B 17/02* (2006.01)
*E21B 31/00* (2006.01)

(52) U.S. Cl.
CPC ..... *E21B 23/03* (2013.01); *E21B 17/023* (2013.01); *E21B 31/007* (2013.01)

(58) Field of Classification Search
CPC ..... E21B 23/03; E21B 17/023; E21B 17/026; E21B 17/06; E21B 31/007
See application file for complete search history.

(56) References Cited

U.S. PATENT DOCUMENTS 3,638,723 A * 2/1972 Carroll ..... E21B 23/02 166/215
2004/0134667 A1* 7/2004 Brewer ..... E21B 17/023 166/380

(Continued)

FOREIGN PATENT DOCUMENTS

WO 2010061231 A1 6/2010
WO 2018112153 A1 1/2018

OTHER PUBLICATIONS

International Search Report with Written Opinion dated Oct. 15, 2020 for PCT Patent Application No. PCT/US2020/040862, 12 pages.

*Primary Examiner* — Taras P Bemko
*Assistant Examiner* — Yanick A Akaragwe
(74) *Attorney, Agent, or Firm* — Smith IP Services, P.C.

(57) ABSTRACT

An apparatus can include a cable head assembly with a cable head stinger connected to a weak link, and a release assembly including a bushing that radially outwardly supports a dog in engagement with an internal groove formed in an outer housing. A method can include connecting a bottom hole assembly to a wireline, the connecting including connecting the wireline to a cable head stinger of a cable head assembly; deploying the wireline and bottom hole assembly into the well; applying a tensile force to the wireline, thereby breaking a weak link of the cable head assembly; and then displacing the cable head stinger into engagement with a bushing of the release assembly, thereby permitting a dog to displace radially inwardly out of engagement with an internal groove in the release assembly.

20 Claims, 7 Drawing Sheets

(56) References Cited

U.S. PATENT DOCUMENTS

| | | | | |
|---|---|---|---|---|
| 2005/0230115 | A1* | 10/2005 | Rose | E21B 17/026 166/301 |
| 2007/0023191 | A1 | 2/2007 | Dreggevik | |
| 2012/0132439 | A1 | 5/2012 | Ratcliffe et al. | |
| 2013/0014934 | A1 | 1/2013 | Macrae et al. | |
| 2013/0161965 | A1 | 6/2013 | Yajure | |

* cited by examiner

RETRIEVAL OF BOTTOM HOLE ASSEMBLY COMPONENTS FROM A SUBTERRANEAN WELL

BACKGROUND

This disclosure relates generally to equipment utilized and operations performed in conjunction with a subterranean well and, in an example described below, more particularly provides for retrieval of bottom hole assembly components from a well.

It can be desirable to be able to release all or part of a bottom hole assembly from a wireline in a well. For example, if the bottom hole assembly has become stuck in the well, it would typically be desirable to be able to retrieve the wireline from the well separate from the bottom hole assembly. Components of the bottom hole assembly remaining in the well can be retrieved later by a "fishing" operation, which is more conveniently performed without the wireline also being in the well.

Therefore, it will be readily appreciated that improvements are continually needed in the art of constructing and utilizing apparatus for releasing all or part of a bottom hole assembly from a wireline in a well. Such improvements could be useful whether or not the bottom hole assembly has become stuck in the well, and for a variety of different purposes.

DETAILED DESCRIPTION

Figure 1:
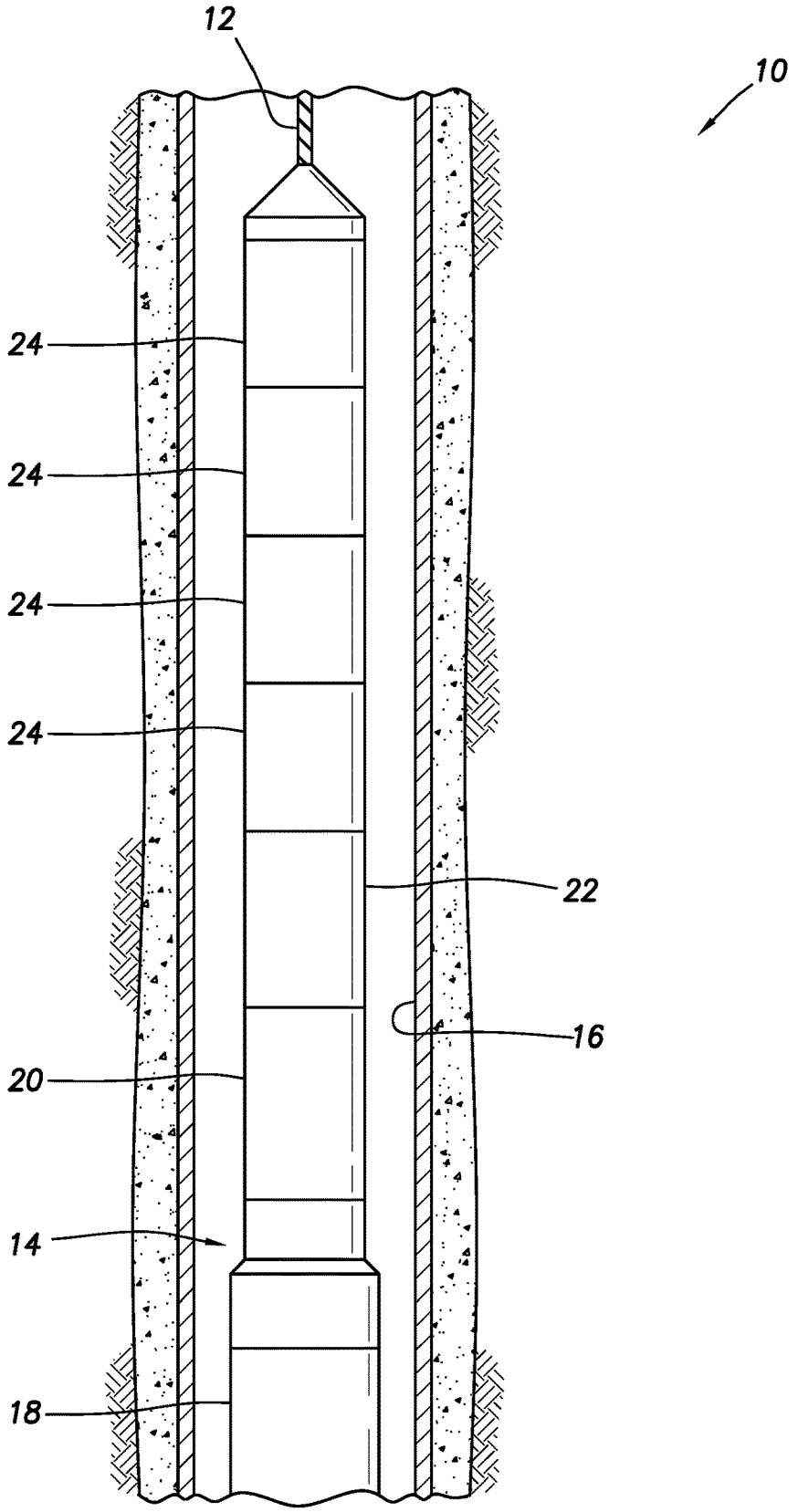
FIG. 1 is a representative partially cross-sectional view of an example of a well system and associated method which can embody principles of this disclosure.

Representatively illustrated in FIG. 1 is a system 10 for use with a well, and associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wireline 12 is used to convey a bottom hole assembly 14 through a wellbore 16. The bottom hole assembly 14 is connected at a distal end of the wireline 12, but is not necessarily positioned at a bottom of the wellbore 16.

The term "wireline" is used herein to indicate a single- or multi-strand wire cable of the type commonly used in well operations, such as, logging and completion operations. The term "wireline" can include armored wire cable, as well as equipment known to those skilled in the art as "slickline" and "e-line."

In an example described more fully below, the wireline 12 includes an internal electrical conductor for communicating electrical power and electrical signals between surface and the bottom hole assembly 14. However, in other examples, an electrical conductor may not be used with the wireline 12.

In the example depicted in FIG. 1, one or more well tools 18 are connected to a cable head assembly 20. The well tools 18 may be any type of wireline-conveyed tools, such as, perforating equipment, logging equipment, a packer or plug, etc. The cable head assembly 20 serves to mechanically and electrically connect the well tools 18 to the wireline 12.

A release assembly 22 is connected above the cable head assembly 20. The release assembly 22 enables the well tools 18 to be disconnected from the wireline 12, for example, in the event that the well tools become stuck in the wellbore 16.

Sinker bars 24 (also known as weight bars) are connected above the release assembly 22. The sinker bars 24 add weight to the bottom hole assembly 14, for example, to aid in conveying the bottom hole assembly past an obstruction in the wellbore 16 or through deviated sections of the wellbore.

In one beneficial feature of the release assembly 22, the sinker bars 24 can be retrieved from the well with the wireline 12 after the release assembly is activated to disconnect the wireline from the well tools 18. However, it is not necessary for sinker bars to be retrieved with a wireline, in keeping with the principles of this disclosure.

Figure 2:
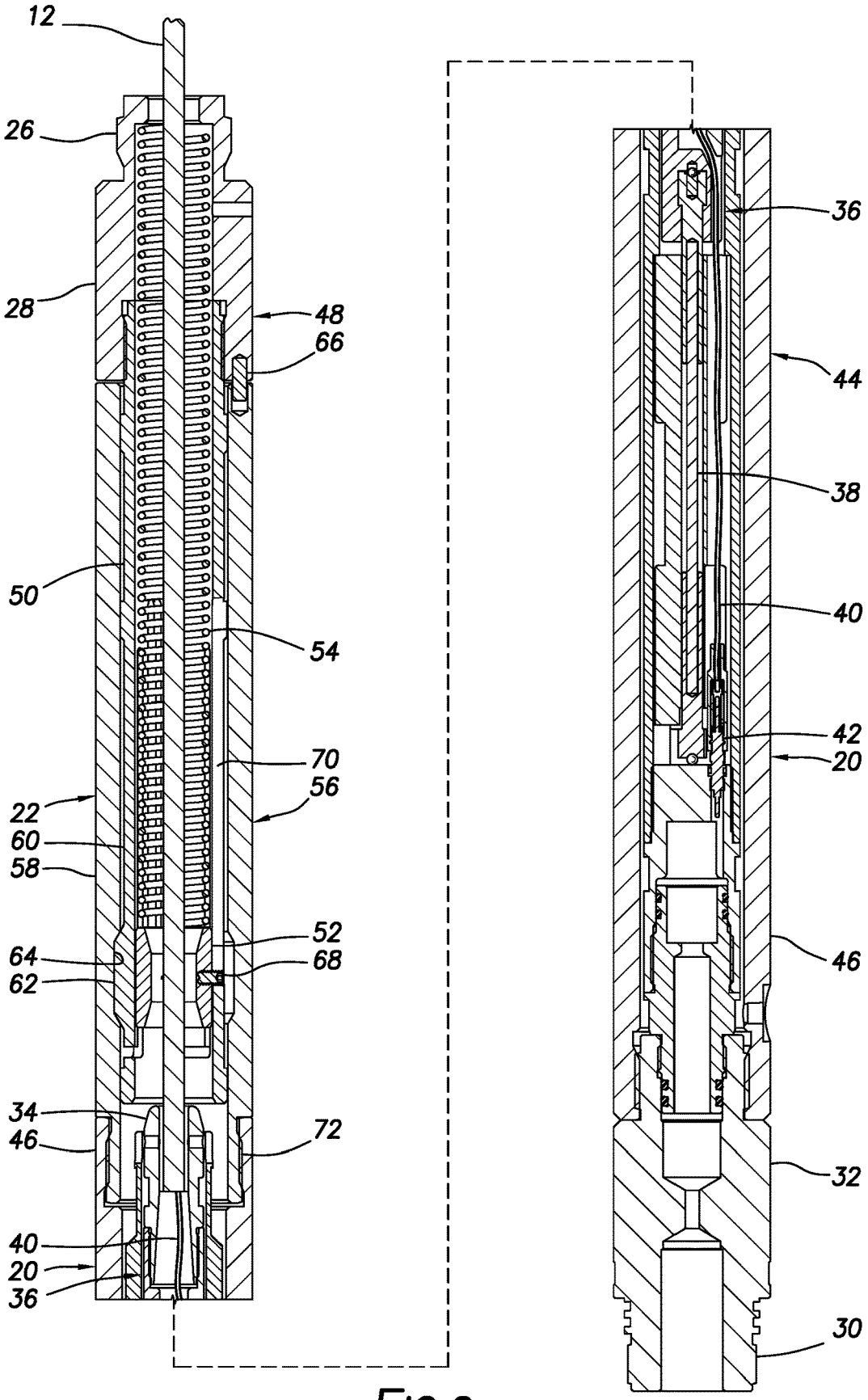
FIG. 2 is a representative cross-sectional view of a release assembly and a cable head assembly that may be used with the system and method of FIG. 1.

Referring additionally now to FIG. 2, examples of the cable head and release assemblies 20, 22 are representatively illustrated apart from the remainder of the well system 10. The cable head and release assemblies 20, 22 may be used with other systems and methods, in keeping with the principles of this disclosure.

In the FIG. 2 example, an externally threaded sinker bar connector 26 is formed on an upper end of a sinker bar adapter 28 of the release assembly 22. An externally threaded well tool connector 30 is formed on a lower end of a tool adapter 32 of the cable head assembly 20. Thus, the cable head and release assemblies 20, 22 are configured to be connected between the well tools 18 and the sinker bars 24 in the FIG. 1 system 10.

A lower or distal end of the wireline 12 is terminated at a cable head stinger 34 in an inner section 36 of the cable head assembly 20. The cable head stinger 34 mechanically connects the wireline 12 to an upper end of a weak link 38 in the inner section 36 of the cable head assembly 20. A lower end of the weak link 38 is connected (via various threaded connections) to the tool adapter 32, so that a tensile force can be transmitted between the well tools 18 and the wireline 12 via the weak link.

The weak link 38 has a lower tensile strength as compared to the wireline 12. Thus, when an increasing tensile force is applied to the wireline 12 and the weak link 38, the weak link will desirably break before the wireline does. In this manner, an operator is ensured that the valuable wireline 12 will be retrievable from the well, even if the well tools 18 and components of the cable head assembly 20 remain in the well.

In the FIG. 2 example, an electrical conductor 40 of the wireline 12 can extend downward through the cable head assembly 20 and to the well tools 18 via the tool adapter 32. A feed-through connector 42 is provided in the cable head assembly 20 for this purpose.

Note that, if the weak link 38 breaks when a sufficient tensile force is applied via the wireline 12, the inner section 36 (including at least the cable head stinger 34 and an upper portion of the weak link) of the cable head assembly 20 will be separated from an outer section 44 of the cable head assembly. The outer section 44 includes at least the tool adapter 32 and an outer housing 46. The electrical conductor 40 will either break or be disconnected from the feed-through connector 42 when the inner section 36 is retrieved from the well separately from the outer section 44 (which will remain in the well with the well tools 18).

The wireline 12 extends longitudinally through the release assembly 22. An upper section 48 of the release assembly 22 includes the sinker bar adapter 28 and an inner generally tubular latch tube 50. A sleeve-type bushing 52 and a spring 54 are positioned in the latch tube 50.

The bushing 52 is configured for complementary engagement with the cable head stinger 34, as described more fully below. In this example, the bushing 52 has an internally tapered lower end that is complementarily shaped relative to an externally tapered upper end of the cable head stinger 34, but other shapes may be used in other examples.

A lower section 56 of the release assembly 22 includes an outer housing 58. The outer housing 58 is connected to the outer housing 46 of the cable head assembly 20. An externally threaded cable housing connector 72 is formed on a lower end of the outer housing 58 for this purpose.

A series of circumferentially distributed resilient collets 60 are formed in a wall of the latch tube 50. At a lower end of each of the collets 60, a radially outwardly extending latch dog 62 is formed.

The dogs 62 engage an internal circumferential profile or groove 64 formed in the outer housing 58. This engagement prevents the outer housing 58 from displacing longitudinally relative to the latch tube 50, and thereby prevents separation of the upper and lower sections 48, 56 of the release assembly 22.

The dogs 62 are radially outwardly supported in engagement with the groove 64 by the bushing 52 in its locked position depicted in FIG. 2. The bushing 52 is reciprocable in the latch tube 50, but is biased toward the locked position by the spring 54.

Thus, unless an upward force is applied to the bushing 52 greater than the downward biasing force exerted by the spring 54, the bushing will remain in its FIG. 2 locked position. Note that travel control screws 68 reciprocably received in slots 70 formed in the wall of the latch tube 50 limit downward displacement of the bushing 52.

In the locked configuration depicted in FIG. 2, relative rotation between the sinker bar adapter 28 and the outer housing 58 is prevented by pins 66. The pins 66 do not prevent longitudinal separation of the sinker bar adapter 28 from the outer housing 58 when the dogs 62 become disengaged from the groove 64, as described more fully below.

Figure 3:
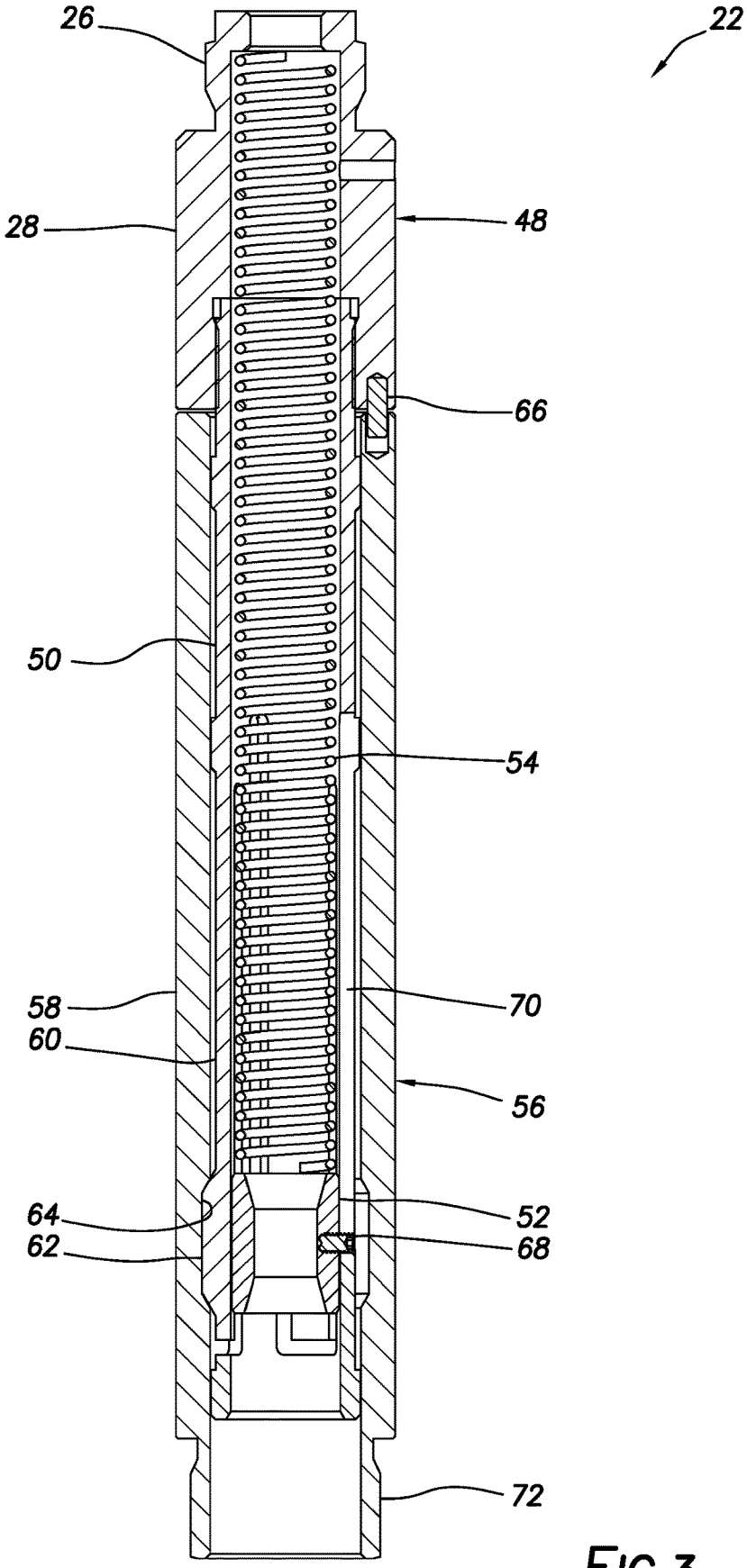
FIG. 3 is a representative cross-sectional view of the release assembly.
Figure 4:
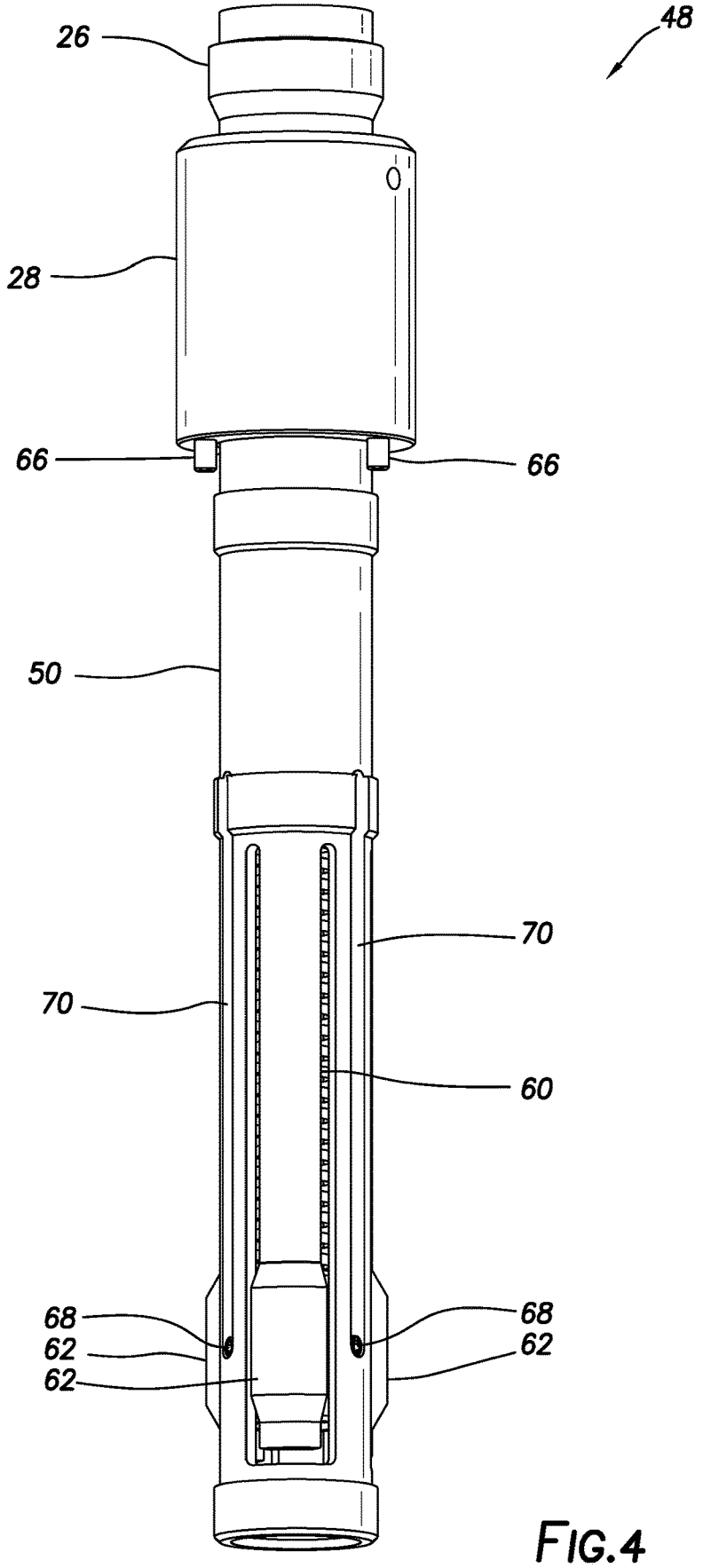
FIG. 4 is a representative side view of a retrievable section of the release assembly.
Figure 5:
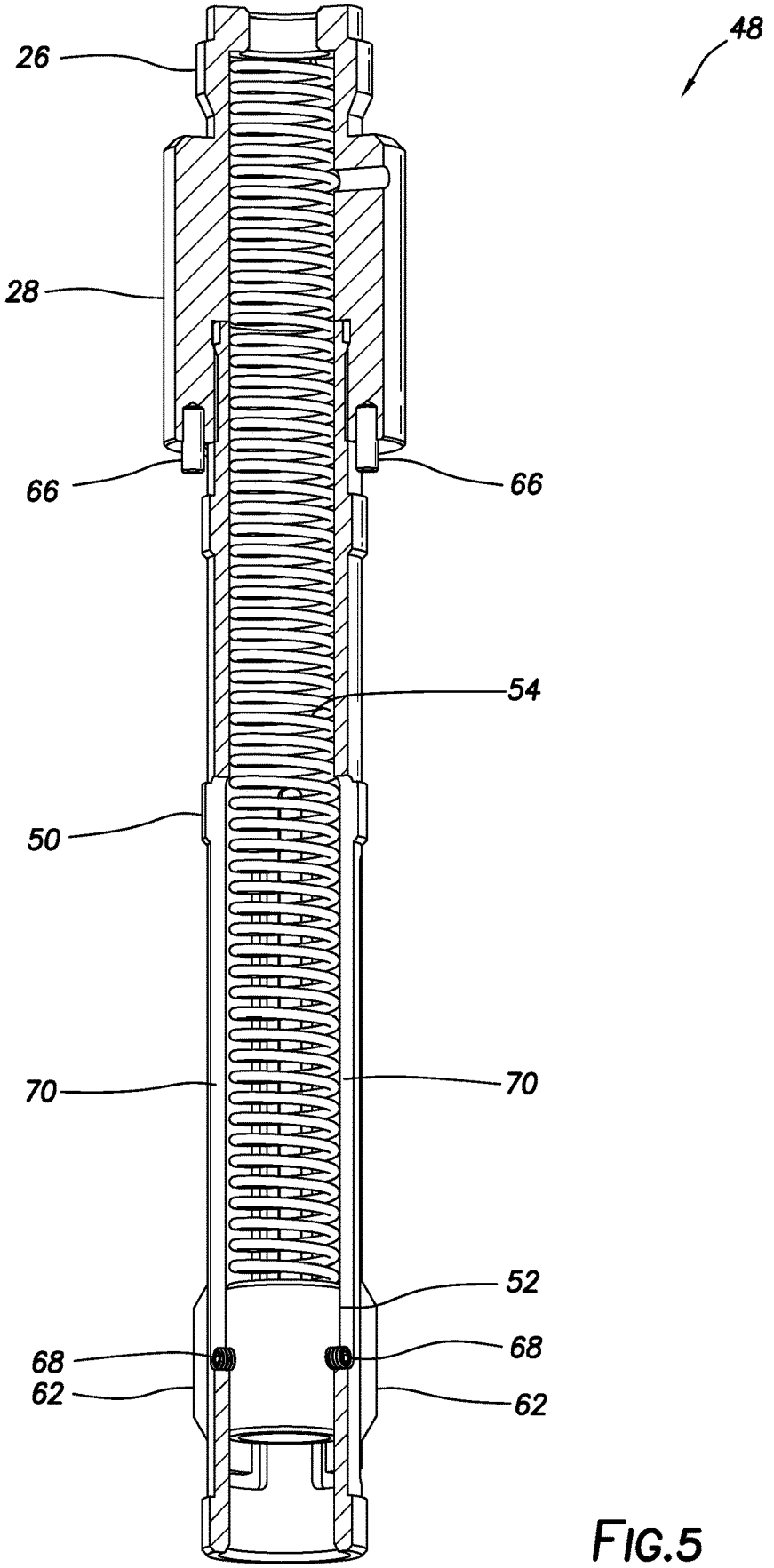
FIG. 5 is a representative partially cross-sectional view of the retrievable section.

Referring additionally now to FIGS. 3-5, more detailed views of the release assembly 22 and its components are representatively illustrated. Note that the release assembly 22 can be used with different cable head assemblies and in different bottom hole assemblies, in keeping with the principles of this disclosure.

In FIG. 3, a cross-sectional view of the release assembly 22 is representatively illustrated. The spring 54 maintains the bushing 52 in the locked position outwardly supporting the dogs 62 in engagement with the groove 64 in the outer housing 58.

In FIGS. 4 & 5, the retrievable upper section 48 of the release assembly 22 is representatively illustrated. In these views, the manner in which the collets 60 are formed in the wall of the latch tube 50, and the travel control screws 68 are received in the slots 70, can be more clearly seen.

Figure 6:
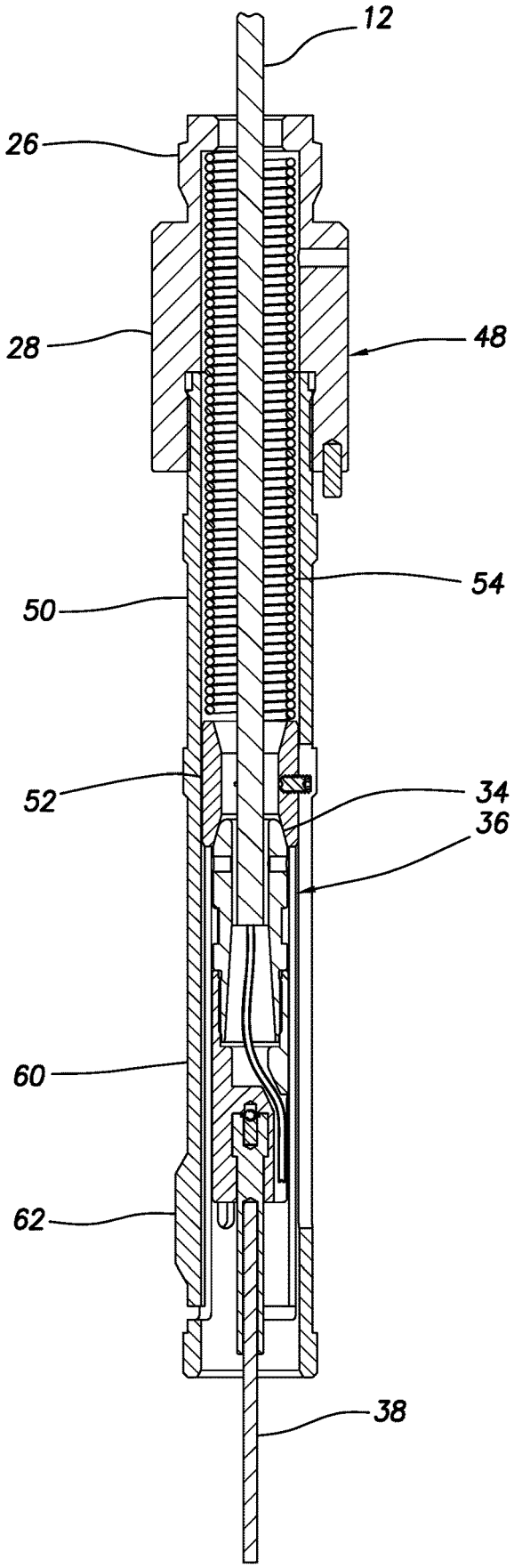
FIG. 6 is a representative cross-sectional view of retrieved sections of the release and cable head assemblies.
Figure 7:
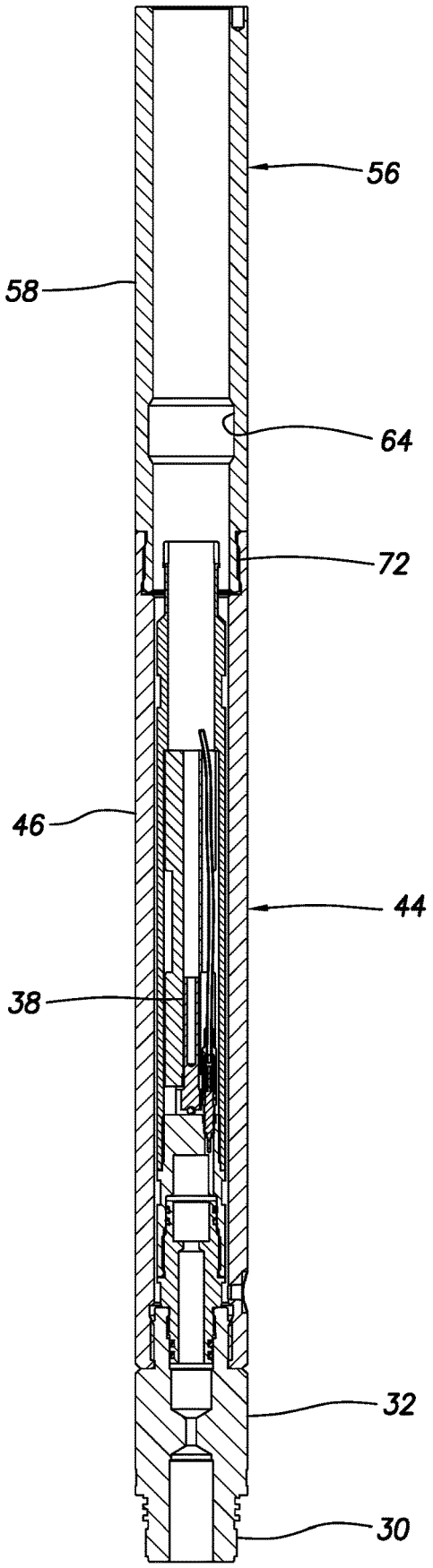
FIG. 7 is a representative cross-sectional view of remaining sections of the release and cable head assemblies.

Referring additionally now to FIGS. 6 & 7, the cable head and release assemblies 20, 22 are representatively illustrated. In these views, the release assembly 22 has been activated, so that the upper section 48 of the release assembly 22 and the inner section 36 of the cable head assembly 20 (depicted in FIG. 6) can be retrieved from the well separate from the lower section 56 of the release assembly and the outer section 44 of the cable head assembly (depicted in FIG. 7).

In FIG. 6, it may be seen that a sufficient tensile force has been applied via the wireline 12 to break the weak link 38. This has enabled the cable head stinger 34 and the rest of the inner section 36 to displace longitudinally upward.

The cable head stinger 34 has contacted the bushing 52. The tensile force applied via the wireline 12 is sufficient to overcome the downwardly biasing force exerted by the spring 54, so that the bushing 52 is displaced upward to its unlocked position.

The bushing 52 no longer outwardly supports the dogs 62. As a result, the dogs 62 have deflected radially inward and out of engagement with the groove 64 in the outer housing 58. This enables the upper section 48 of the release assembly 22 and the inner section 36 of the cable head assembly 20 to separate from the lower section 56 of the release assembly and the outer section 44 of the cable head assembly (see FIG. 7).

The wireline 12, the upper section 48 of the release assembly 22 (and any sinker bars 24 connected above the upper section 48) and the inner section 36 of the cable head assembly 20 can now be retrieved from the well. The lower section 56 of the release assembly 22 and the outer section 44 of the cable head assembly 20 (and any well tools 18 connected below the outer section) can later be retrieved from the well, if desired.

It may now be fully appreciated that the above disclosure provides significant advancements to the art of constructing and utilizing apparatus for releasing all or part of a bottom hole assembly from a wireline in a well. In an example described above, the wireline 12 can be conveniently released from well tools 18 of the bottom hole assembly 14, and the sinker bars 24 can be retrieved from the well with the wireline.

The above disclosure provides to the art an apparatus for use in a subterranean well. In one example, the apparatus can comprise: a cable head assembly 20 including a cable head stinger 34 connected to a weak link 38; and a release assembly 22 including a bushing 52 that radially outwardly supports a dog 62 in engagement with an internal groove 64 formed in an outer housing 58. In a locked configuration (e.g., see FIG. 2), the bushing 52 is longitudinally spaced apart from the cable head stinger 34. In a released configuration (e.g., see FIGS. 6 & 7), the cable head stinger 34 engages and displaces the bushing 52, the dog 62 is not radially supported by the bushing 52, and the cable head stinger 34 is retrievable from the well.

The weak link 38 may comprise a mechanical connection between inner and outer sections 36, 44 of the cable head assembly 20.

The release assembly 22 may include a spring 54 that biases the bushing 52 in a direction toward the cable head stinger 34.

The engagement between the dog 62 and the groove 64 may releasably secure an upper section 48 of the release assembly 22 to a lower section 56 of the release assembly 22.

The upper section 48 of the release assembly 22 may include a sinker bar connector 26, the spring 54, the bushing 52 and the dog 62.

In the released configuration, the cable head stinger 34 is retrievable with the release assembly upper section 48. In the released configuration, the inner section 36 may be retrievable with the release assembly upper section 48.

Also provided to the art by the above disclosure is method for use with a subterranean well. In one example, the method can comprise: connecting a bottom hole assembly 14 to a wireline 12, the bottom hole assembly 14 including a release assembly 22 and a cable head assembly 20, the connecting step including connecting the wireline 12 to a cable head stinger 34 of the cable head assembly 20; deploying the wireline 12 and bottom hole assembly 14 into the well; applying a tensile force to the wireline 12, thereby breaking a weak link 38 of the cable head assembly 20; and then displacing the cable head stinger 34 into engagement with a bushing 52 of the release assembly 22, thereby permitting a dog 62 to displace radially inwardly out of engagement with an internal groove 64 in the release assembly 22.

The method can include: connecting at least one sinker bar 24 to an upper section 48 of the release assembly 22; and retrieving the sinker bar 24 with the cable head stinger 34 from the well after the displacing step.

The weak link 38 breaking step may include separating the cable head stinger 34 from the cable head assembly 20.

The method may include retrieving the wireline 12, the cable head stinger 34, the bushing 52 and the dog 62 from the well.

The cable head stinger 34 displacing step may include compressing a spring 54 that biases the bushing 52 toward a position at which the bushing 52 radially outwardly supports the dog 62.

The spring 54 and the bushing 52 may be received in a latch tube 50, and the dog 62 may be formed on a wall of the latch tube 50.

The latch tube 50 may be secured to a sinker bar adapter 28, and at least one sinker bar 24 may be secured to the sinker bar adapter 28.

Also described above is a release assembly 22 for detaching a wireline 12 from a bottom hole assembly 14 in a well. In one example, the release assembly 22 can comprise: a sinker bar adapter 28 configured to secure at least one sinker bar 24 to the release assembly 22; a latch tube 50 secured to the sinker bar adapter 28, the latch tube 50 having a series of circumferentially distributed resilient collets 60 formed in a wall of the latch tube 50, each of the collets 60 having a dog 62 formed thereon; an outer housing 58 outwardly overlying the latch tube 50, the outer housing 58 having an internal locking groove 64 formed therein; a spring 54 positioned in the latch tube 50; and a bushing 52 reciprocably disposed in the latch tube 50. The bushing 52 has a locked position in which the bushing 52 radially outwardly supports the dogs 62 in engagement with the locking groove 64, and an unlocked position in which the dogs 62 are unsupported by the bushing 52. The spring 54 biases the bushing 52 toward the locked position.

The sinker bar 24 may be secured to the sinker bar adapter 28.

The outer housing 58 may include a cable head assembly connector 72 formed at one end of the outer housing 58.

The bushing 52 may be complementarily shaped relative to a cable head stinger 34. The bushing 52 may be configured to receive the cable head stinger 34 therein.

Longitudinal displacement of the outer housing 58 relative to the latch tube 50 is prevented with the bushing 52 in the locked position, and longitudinal displacement of the outer housing 58 relative to the latch tube 50 is permitted with the bushing 52 in the unlocked position.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An apparatus for use in a subterranean well, the apparatus comprising:

a cable head assembly including a cable head stinger connected to a weak link; and a release assembly including a bushing that radially outwardly supports a dog in engagement with an internal groove formed in an outer housing, in which in a locked configuration the bushing is longitudinally spaced apart from the cable head stinger, and in a released configuration the cable head stinger engages and displaces the bushing, the dog is not radially supported by the bushing, and the cable head stinger is retrievable from the well.

2. The apparatus of claim 1, in which the weak link comprises a mechanical connection between inner and outer sections of the cable head assembly.

3. The apparatus of claim 1, in which the release assembly further comprises a spring that biases the bushing in a direction toward the cable head stinger.

4. The apparatus of claim 3, in which the engagement between the dog and the groove releasably secures an upper section of the release assembly to a lower section of the release assembly.

5. The apparatus of claim 4, in which the upper section of the release assembly comprises a sinker bar connector, the spring, the bushing and the dog.

6. The apparatus of claim 5, in which, in the released configuration, the cable head stinger is retrievable with the release assembly upper section.

7. The apparatus of claim 6, in which the weak link comprises a mechanical connection between inner and outer sections of the cable head assembly, and in the released configuration, the inner section is retrievable with the release assembly upper section.

8. A method for use with a subterranean well, the method comprising:

connecting a bottom hole assembly to a wireline, the bottom hole assembly including a release assembly and a cable head assembly, the connecting comprising connecting the wireline to a cable head stinger of the cable head assembly;

deploying the wireline and bottom hole assembly into the well;

applying a tensile force to the wireline, thereby breaking a weak link of the cable head assembly; and then displacing the cable head stinger into engagement with a bushing of the release assembly, thereby permitting a dog to displace radially inwardly out of engagement with an internal groove in the release assembly.

9. The method of claim 8, further comprising:

connecting at least one sinker bar to an upper section of the release assembly; and retrieving the at least one sinker bar with the cable head stinger from the well after the displacing.

10. The method of claim 8, in which the weak link breaking comprises separating the cable head stinger from the cable head assembly.

11. The method of claim 8, further comprising retrieving the wireline, the cable head stinger, the bushing and the dog from the well.

12. The method of claim 8, in which the cable head stinger displacing comprises compressing a spring that biases the bushing toward a position at which the bushing radially outwardly supports the dog.

13. The method of claim 12, in which the spring and the bushing are received in a latch tube, and in which the dog is formed on a wall of the latch tube.

14. The method of claim 8, in which the latch tube is secured to a sinker bar adapter, and at least one sinker bar is secured to the sinker bar adapter.

15. A release assembly for detaching a wireline from a bottom hole assembly in a well, the release assembly comprising:

a sinker bar adapter configured to secure at least one sinker bar to the release assembly;

a latch tube secured to the sinker bar adapter, the latch tube having a series of circumferentially distributed resilient collets formed in a wall of the latch tube, each of the collets having a dog formed thereon;

an outer housing outwardly overlying the latch tube, the outer housing having an internal locking groove formed therein;

a spring positioned in the latch tube; and a bushing reciprocably disposed in the latch tube, the bushing having a locked position in which the bushing radially outwardly supports the dogs in engagement with the locking groove, and an unlocked position in which the dogs are unsupported by the bushing, and in which the spring biases the bushing toward the locked position.

16. The release assembly of claim 15, in which the at least one sinker bar is secured to the sinker bar adapter.

17. The release assembly of claim 15, in which the outer housing includes a cable head assembly connector formed at one end of the outer housing.

18. The release assembly of claim 15, in which the bushing is complementarily shaped relative to a cable head stinger.

19. The release assembly of claim 15, in which the bushing is configured to receive a cable head stinger therein.

20. The release assembly of claim 15, in which longitudinal displacement of the outer housing relative to the latch tube is prevented with the bushing in the locked position, and longitudinal displacement of the outer housing relative to the latch tube is permitted with the bushing in the unlocked position.

* * * * *